US010980365B1

(12) United States Patent
Ogden

(10) Patent No.: US 10,980,365 B1
(45) Date of Patent: Apr. 20, 2021

(54) PILLOWCASE WHOSE INTERNAL CAVITY ACCOMMODATES AN OPEN POCKET INTO WHICH IS FITTED A NECK SUPPORT CUSHION

(71) Applicant: Patsy Ogden, Pleasantville, NY (US)

(72) Inventor: Patsy Ogden, Pleasantville, NY (US)

( * ) Notice: Subject to any disclaimer, the term of this patent is extended or adjusted under 35 U.S.C. 154(b) by 0 days.

(21) Appl. No.: 17/089,829

(22) Filed: Nov. 5, 2020

Related U.S. Application Data

(60) Provisional application No. 62/948,055, filed on Dec. 23, 2019.

(51) Int. Cl.
*A47G 9/02* (2006.01)
*A47G 9/10* (2006.01)

(52) U.S. Cl.
CPC ..... *A47G 9/0253* (2013.01); *A47G 9/1081* (2013.01)

(58) Field of Classification Search
CPC ..... A47G 9/0253; A47G 9/1081
See application file for complete search history.

(56) References Cited

U.S. PATENT DOCUMENTS 2,895,146 A * 7/1959 Lester ..... A47G 9/0253 5/490
4,956,886 A * 9/1990 Sarkozi ..... A47G 9/10 5/636
7,089,617 B1 8/2006 Lauro
10,426,242 B1 * 10/2019 Little ..... A45F 4/02
10,499,755 B2 12/2019 Aramli
10,561,259 B1 * 2/2020 Gaspari ..... A47G 9/0253
10,582,784 B2 3/2020 Biebl
10,722,054 B2 7/2020 Staton
D899,813 S 10/2020 Borstel
2011/0145994 A1 * 6/2011 Pileggi ..... A47G 9/1081 5/655.3
2014/0000034 A1 * 1/2014 Alexander ..... A47G 9/1081 5/636
2014/0230151 A1 * 8/2014 Kim ..... A47G 9/1081 5/640
2015/0230635 A1 * 8/2015 Abrams ..... A47C 7/383 5/636
2018/0028002 A1 * 2/2018 Lou ..... A47G 9/1081
2019/0374052 A1 * 12/2019 McKinney ..... A47G 9/1045
2020/0178709 A1 * 6/2020 Brown ..... A47G 9/10

* cited by examiner

*Primary Examiner* — Eric J Kurilla

(74) *Attorney, Agent, or Firm* — Robert J. Hess; Hess Patent Law Firm

(57) ABSTRACT

A pillowcase having a cavity that accommodates therein a pillow and having an open pocket within the cavity that accommodates therein a neck support cushion. The open pocket has a slit that is fully accessible after folding the pillowcase inside out. The open pocket may be closed by a releasable fastener, such as fabric strips that tie to each other into knots across the slit.

7 Claims, 4 Drawing Sheets

PILLOWCASE WHOSE INTERNAL CAVITY ACCOMMODATES AN OPEN POCKET INTO WHICH IS FITTED A NECK SUPPORT CUSHION

CROSS-REFERENCE TO RELATED APPLICATIONS

The present application asserts the benefit of invention priority from U.S. provisional patent application No. 62/948,055 that was filed on Dec. 23, 2019.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable

BACKGROUND OF THE INVENTION

(1) Field of the Invention

The invention pertains to a pillowcase that has an open pocket into which is fitted a neck support cushion. A pillow can be fitted into the cavity of the pillowcase adjacent to the open pocket.

(2) Description of Related Art Including Information Disclosed Under 37 CFR 1.97 and 1.98

U.S. Pat. No. 10,722,054 mentions:

Typically pillowcases designed for bed pillows are widely used and known to human for many years. Such pillowcases mainly comprise of two sides of any suitable fabric material sewn together on three sides and open at one side for receiving the bed pillow or the cushion. Such pillowcases beyond receiving the bed pillow or the cushion aren't capable of holding any other object. A few of pillowcases include one or more external pockets with some closure means (e.g. a Zipper or a Velcro®) designed to hold one or more small object such as a phone or any other valuable items.

For example, U.S. Pat. No. 7,089,617 discloses a pillowcase that includes an extension that can be turned into an interior pocket for a pillow. The interior pocket has an opening providing access for storing and retrieving small articles such as text notes, greeting cards, photographs, and soft sculptures.

U.S. Pat. No. 10,582,784 mentions:

Neck pillows have previously been described. These usually comprise a surface contour which have their highest point of pressure in the area of the upper to middle cervical spine and thus lead to an unfavorable (for the nervous system) to high pressure to the upper cervicals, particularly to the atlas and axis in the anterior direction. This can cause headaches and, in extreme cases, nervous disorders and circulatory disorders as well as sleep disorders. Other previously-described pillows support the cervical spine, but, considered in a longitudinal direction, fall too far back off towards the head and then too rapidly so that too much pressure is exerted on the uppermost cervical C1, the atlas. No pillow to date completely supports the cervical spine, thoracic spine, shoulders, and arms satisfactorily, and which is sufficiently adjustable. The position of the arms when lying on the side has to date not been considered. Previously-described neck pillows are not sufficiently adaptable to different cervical spines.

Clearly, there is room for improvement in the art of neck pillows. Consumers purchase specific kinds of pillows for any number of reasons, such as comfort, support, price, durability, etc. If they desire to switch to a neck pillow, they generally have to give up the choice of pillow in favor of the neck pillow. The present inventor believes that is an unnecessary sacrifice imposed on the consumer. In addition, such limits the ability of consumers to take advantage of the latest improvements and developments in pillow design and manufacture, because they either need to hope the neck pillow supplier catches up or the consumer will need to refrain from realizing the benefit of a neck support cushion in favor of keeping their desired pillow.

Indeed, the reason and purpose for devising a new pillowcase design was based on research on how we sleep and how Americans (over 50 million of us have neck problems and pain). After interviewing several individuals, the inventor found that many of them were not completely satisfied with their pillows and in fact they have tried many different styles of pillows throughout the years. Research also disclosed that the current pillow design most people use (the typical tear shape pillow) has been around for thousands of years and the fact we're still using it today shows that we've made very little progress in improving how we rest our necks when we sleep!

Most pillows do not give the neck the proper support it needs. It's no wonder why so many people have neck problems. Although the typical pillow may give your head a soft place to lay, it also leaves a gap between your head and shoulder leaving a gap with little or no neck support.

It is desired to provide a consumer with neck support cushion support that stays in an appropriate position to provide comfort to the person during their sleep without any need for the consumer giving up their preferred choice of pillow.

Conventional, releasable, fastening techniques are known for closing openings on fabrics. Such conventional, releasable, fastening techniques include, but are not limited to, the use of magnets, zippers, hook-and-loop fasteners, snap fasteners, buttons, a knotted string inserted through alternating loops, and tied fabric strips.

A pair of magnets whose faces have opposite magnetic polarity attract each other (as opposed to faces with the same polarity that repulse each other). Such magnets may be placed into pockets sewn adjacent to an opening that is to be closed. When the faces of the pair of such magnets are aligned one over the other, their magnetic attractive force causes them magnetically cling to each other, thereby closing the opening. When pulled apart under manual force, the magnets separate to allow access to through the opening.

Zippers consist of two rows of protruding teeth, which may be made to interdigitate, linking the rows, carrying from tens to hundreds of specially shaped metal or plastic teeth. These teeth can be either individual or shaped from a continuous coil. The slider, operated by hand, moves along the rows of teeth. Inside the slider is a Y-shaped channel that meshes together or separates the opposing rows of teeth, depending on the direction of the slider's movement.

Hook-and-loop fasteners, hook-and-pile fasteners or touch fasteners (often referred to by the genericized trademark VELCRO, consist of two components: typically, two lineal fabric strips (or, alternatively, round "dots" or squares) which are attached (sewn or otherwise adhered) to the opposing surfaces to be fastened. The first component features tiny hooks, the second features smaller loops. When the two are pressed together the hooks catch in the loops and the two pieces fasten or bind temporarily. When separated, by pulling or peeling the two surfaces apart, the strips make a distinctive "ripping" sound.

A snap fastener is a pair of interlocking discs, made out of a metal or plastic. A circular lip under one disc fits into a groove on the top of the other, holding them fast until a certain amount of force is applied. Different types of snaps can be attached to fabric or leather by riveting with a punch and die set specific to the type of rivet snaps used (striking the punch with a hammer to splay the tail), sewing, or plying with special snap pliers.

A button is a small fastener, now most commonly made of plastic, but also may be made of metal, wood, or seashell, that joins two pieces of fabric together. The button is sewn onto one of the two pieces of fabric and a slit is made into the other of two pieces of fabric and aligned with each other to allow the button to be inserted through the slit where the button remains, joining the two pieces of fabric together.

A string is a long flexible structure made from fibers that are twisted together into a single strand, or from multiple such strands which are in turn twisted together. A string can be used to fasten together two pieces of fabric by providing each fabric with a set of loops that are arranged to alternate with each other and through which is inserted the string, when then can be knotted at opposite ends to prevent the string from inadvertently being pulled through the loops since the knots take up more volume than the size of at least the neighboring loop openings.

Tied fabric strips are strips of fabric tied together to close an opening. That is, one set of fabric strips have one end sewn on one side of an opening and another set of fabric strips have another end sewn on the other side of the opening. When pairs of the fabric strips are tied together (i.e., each pair is one fabric strip of one set and other fabric strip of another set), the opening closes. When the fabric strips are untied, access through the opening is enabled.

SUMMARY OF THE INVENTION

One aspect of the invention resides in a pillowcase having a pocket sized to accommodate a conventional pillow and an adjacent pocket that accommodates a neck support cushion. Preferably, both pockets extend the length of the pillowcase.

Another aspect resides in the pocket for the neck support cushion having a lengthwise opening that can be closed to retain the neck support cushion within the pocket for the neck support cushion and that can be opened to remove the neck support cushion. The closing of the neck support cushion may be provided by any conventional releasable fastening technique.

A further aspect resides in choosing the conventional releasable fastening technique with fabric strips that tie together and whose ends are sewn onto the pillowcase by the neck support cushion opening so that tying them closes the opening. Access to the neck support cushion opening is from the inside of the pillowcase rather than from the outside so that one may need to fold the pillowcase inside out to gain full access to the neck support cushion opening and thereby to tie or untie the fabric strips.

BRIEF DESCRIPTION OF THE SEVERAL VIEWS OF THE DRAWING(S)

For a better understanding of the present invention, reference is made to the following description and accompanying drawings, while the scope of the invention is set forth in the appended claims.

DETAILED DESCRIPTION OF THE INVENTION

Figure 1:
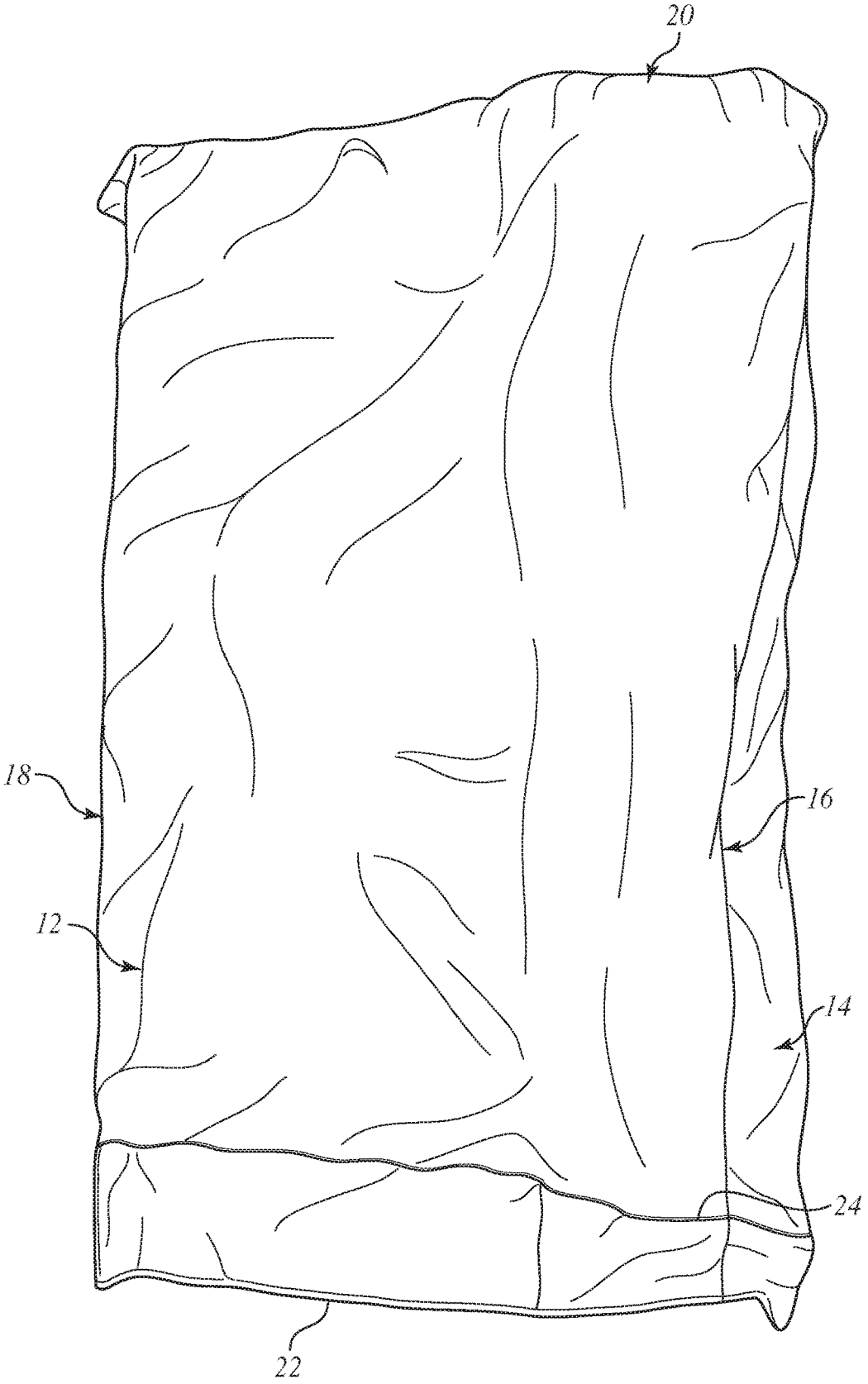
FIG. 1 is an isometric bottom end view of a pillowcase in accordance with the invention with the pillowcase open end folded.
Figure 2:
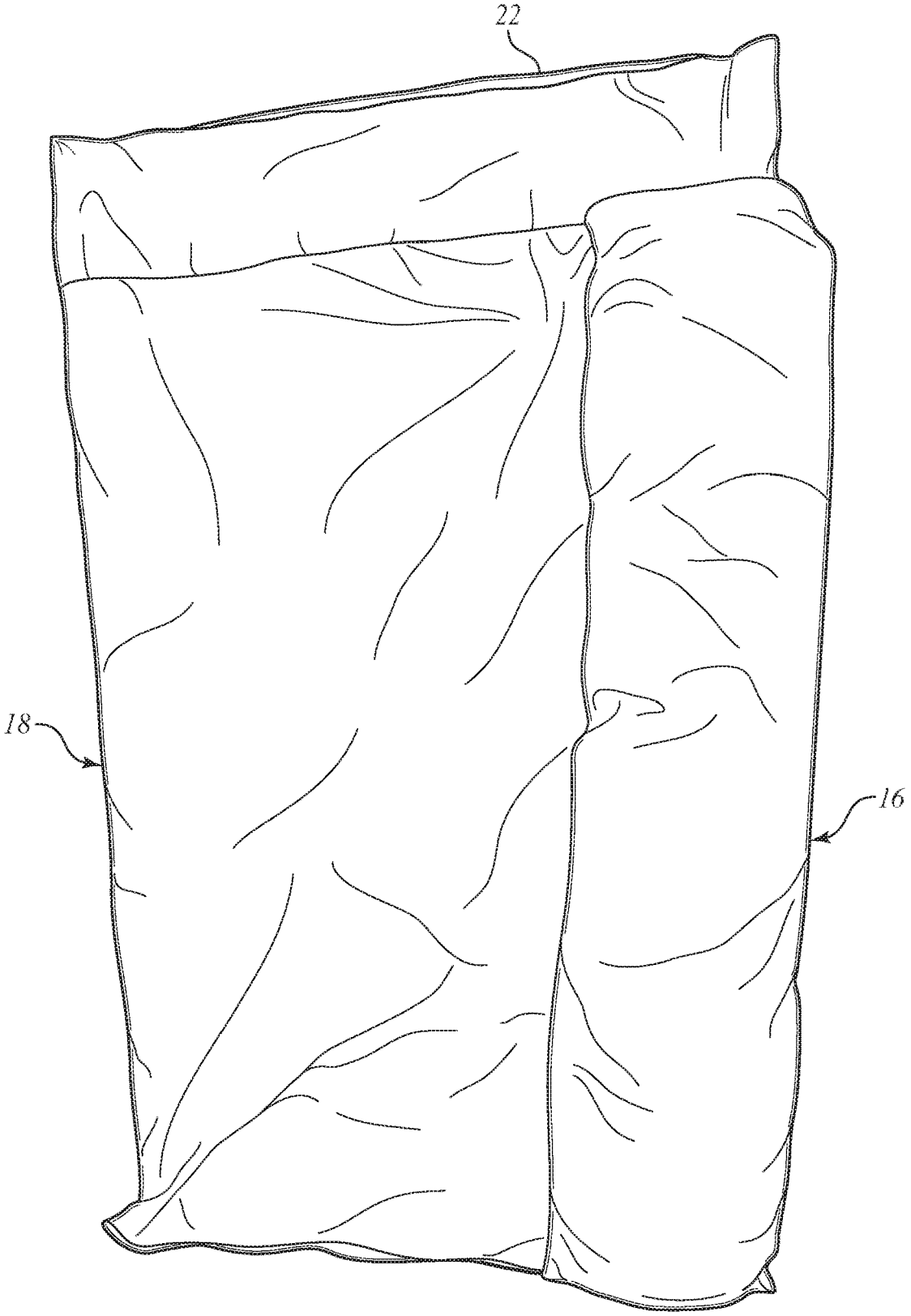
FIG. 2 is an isometric top view of the pillowcase of FIG. 1.
Figure 3:
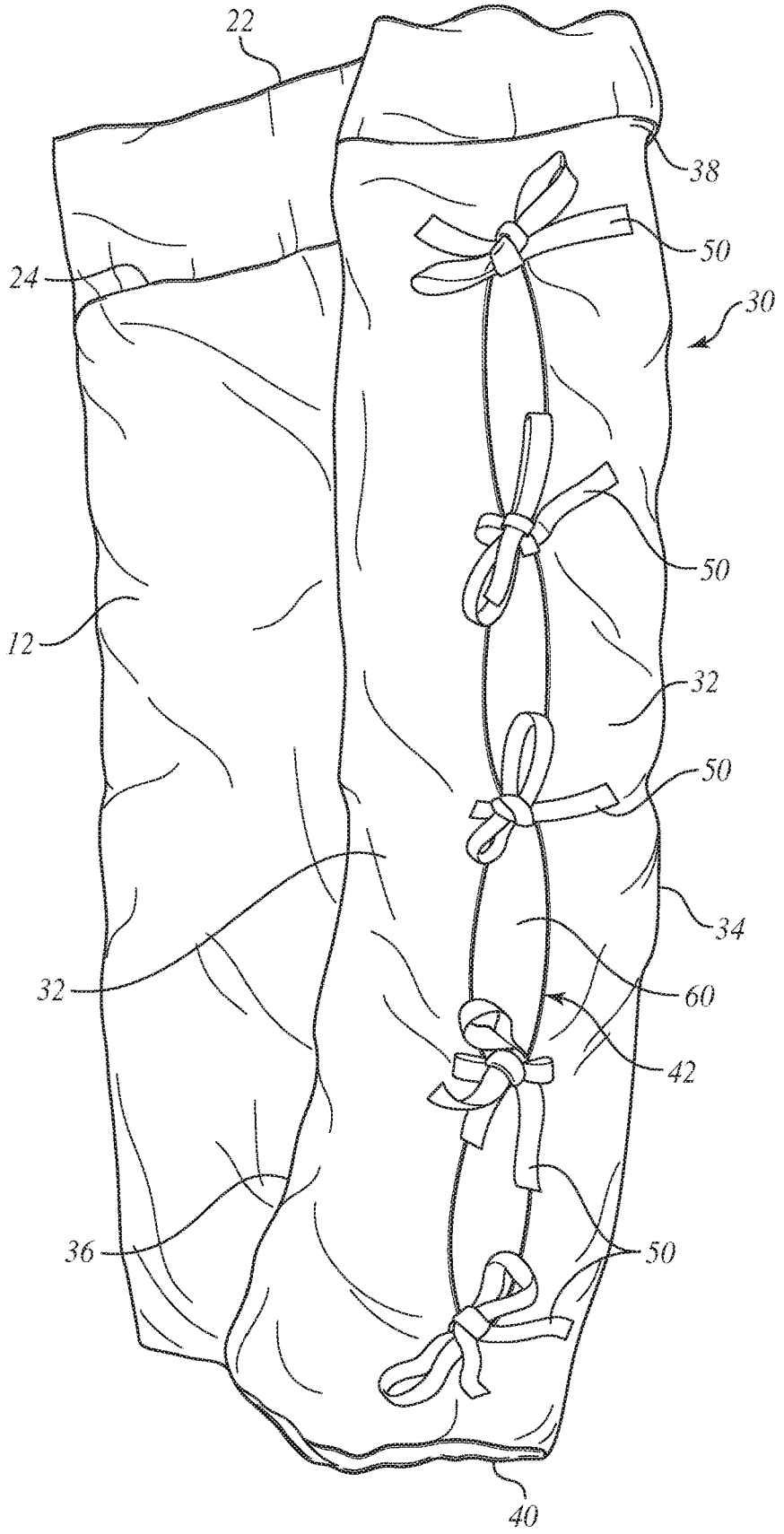
FIG. 3 is an inside out view of the pillowcase of FIGS. 1-3 showing the closed opening of the neck support cushion opening with a portion of the neck support cushion visible within.

FIGS. 1-3 show a pillowcase 10 having two fabric side panels 12, 14 connected together at two common side margins 16, 18 and at one common end margin 20 so as to define within a cavity. The remaining end is unconnected to form an opening 22 in communication with the cavity.

FIG. 3 also shows an open pocket 30 closed by releasable fasteners that are in the form of knotted or tied together fabric straps 50. The open pocket 30 includes a pocket panel 32 whose two side edges 34, 36 and two end edges 38, 40 are connected to the one of the two fabric side panels 12 to bound a portion of the one of the two side panels 12. A lengthwise slit 42 extends between the two end edges 38, 40, but is shorter than the length of the pocket panel 32. The slit 42 may either be in the pocket panel 32 itself or in the portion of the one of the two side panels 12 that is bounded by the pocket panel 32.

Figure 4:
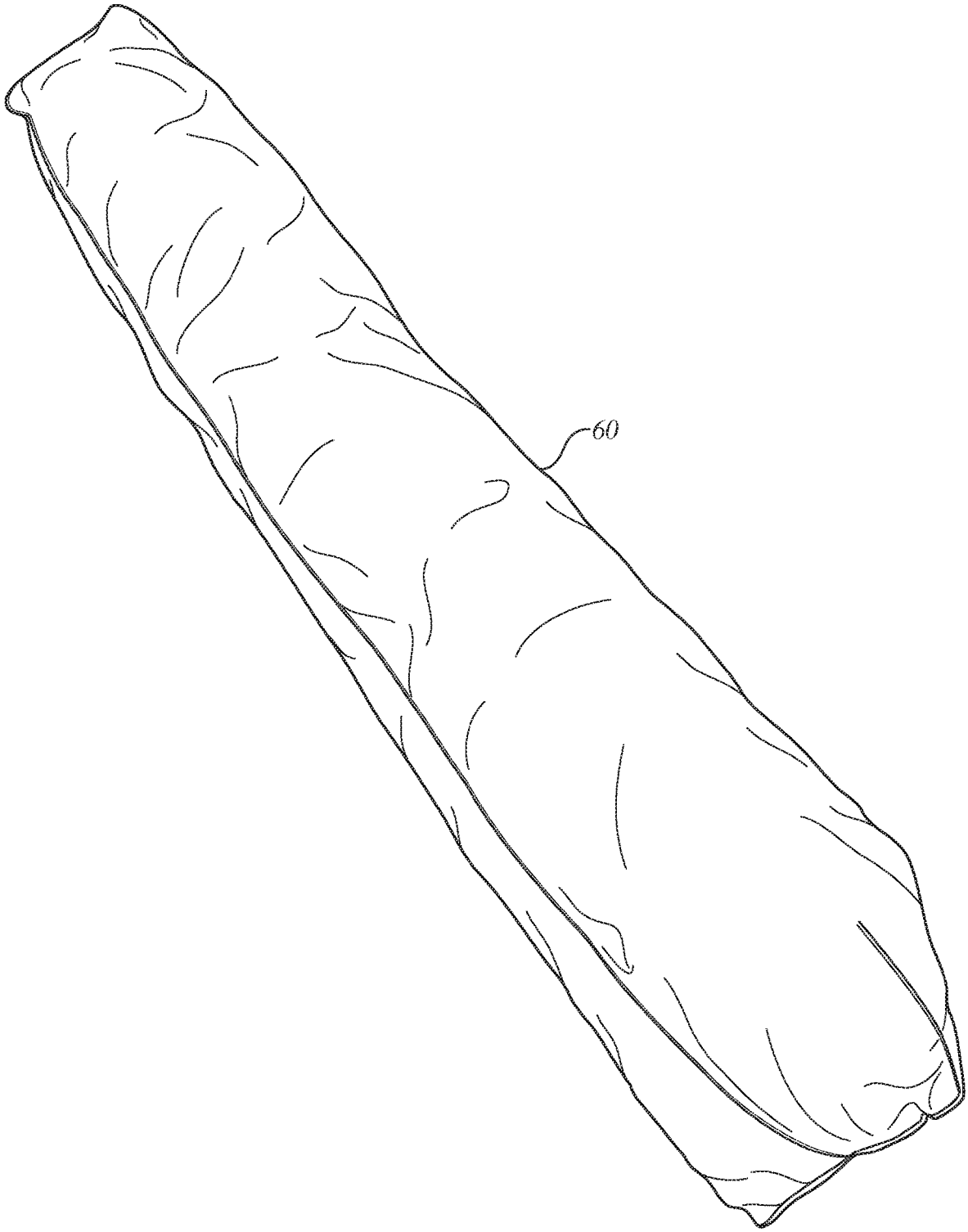
FIG. 4 is an isometric view of the neck support cushion and depicting its longitudinal seam as well as one of two of its symmetric end seams. Although the neck support cushion is partially seen through the open pocket slit of FIG. 3, the longitudinal seam in FIG. 4 is on the diametrically opposite side to that of the side seen through the open pocket slit in FIG. 3.

A neck support cushion 60 is inserted into the open pocket 30 when the pillowcase is folded inside out in the manner of FIG. 3. Unlike common pillowcases. the present invention has two compartments, one for the pillow and one for an interchangeable neck support cushion which may be referred to as a loaf. The loaf is a neck support cushion 60 of FIG. 4 that is sized to fill the average gap between our head and shoulders and can be made of tempered foams and/or a sealed pad stuffed with shreds of different shaped substances made from foam, polyester or possibly even feathers. A fabric having two longitudinal edges and two pairs of end edges is wrapped around such contents and the two longitudinal edges are sewn together to form a seam and each pair of the two pairs of end edges is sewn together to form end seams. Each end seam has a portion that is perpendicular to the longitudinal seam and remaining portions that are inclined on either side of the neck support cushion 60 in the manner shown in FIG. 4 for one of the inclined remaining portions.

To access the interior of the open pocket 30, the tied pairs of fabric straps 50 need to be untied. After insertion of the neck support cushion 60 into the open pocket 30, the pairs of fabric straps 50 are tied again. Each pair of fabric straps 50 includes an end of one of the fabric straps 50 sewn to a portion of the pocket panel 32 close to one side of lengthwise slit 42 and includes a further end of a further one of the fabric straps 50 sewn to a further portion of the pocket panel close to an opposite side of the lengthwise slit 42.

As an alternative to fabric straps 50 that need to be tied, any conventional, releasable, fasteners may be used, such magnets, zippers, hook-and-loop fasteners, snap fasteners, buttons, a knotted string inserted through alternating loops, and tied fabric strips. An example as to how such conventional, releasable, fasteners may be used to close a fabric opening is depicted in FIGS. 7 and 12-14 of U.S. Pat. No. 10,499,755, whose contents are incorporated herein by reference with respect to its FIGS. 7 and 12-14 and accompanying discussion.

The neck support cushion 60 may be tubular in shape and fits into the open pocket 30 to become its contents. The open pocket 30 does not necessarily extend the full length of the pillowcase 10. For instance, it is common practice for the open end of a pillowcase to have an edge defined by fabric turning back to overlap itself by a distance. At the end of that distance, the end of the pillowcase is sewn to the pillowcase to form a seam 24. It is at this seam where the proximal end 44 of the open pocket 30 may be sewn to connect with the pillowcase 10 as well so that the open pocket 30 extends from such a seam to the common end margin of the pillowcase. The distal end 46 of the open pocket 30 may be sewn at or neighboring the common end margin 20 of the pillowcase 10.

An alternative might be to make the neck support cushion separate from the pillow. That way, the consumer can keep their choice of pillow. However, people do move around when they sleep so there is little assurance that a separate neck support cushion will retain its position relative to the pillow while the sleeping person moves in their sleep. Indeed, such a sleeping person might even adjust the pillow to change their sleep position and inadvertently leave behind the separate neck support cushion, thereby creating the possibility that the neck support cushion is no longer situated in a comfortable position under the person's neck relative to the change in pillow position. Thus, the sleeping person might wake up to make an adjustment or push aside the neck support cushion altogether, thereby eliminating the comfort the neck support cushion might otherwise provide had it been retained in its appropriate relative position to the pillow. For that reason, it is preferable that the pillowcase 10 have two compartments: one for accommodating the pillow and one for accommodating the neck support cushion (or loaf).

The pillow (not shown) may be any conventional pillow that gets fitted into any conventional pillowcase, such as any of the conventional pillows shown in FIGS. 4-8 of U.S. Pat. No. 7,089,617 B1. Another example of a conventional pillow is shown in U.S. Pat. No. D899,813 S, whose contents are incorporated herein by reference.

While the foregoing description and drawings represent the preferred embodiments of the present invention, it will be understood that various changes and modifications may be made without departing from the scope of the present invention.

What is claimed is:

1. A pillowcase, comprising:

two fabric side panels connected together along common side margins and along one common end margin to define a cavity therein, said two fabric side panels being unconnected at a remaining end margin thereof to define an open end in communication with the cavity, the cavity being dimensioned to accommodate fitting a pillow and a neck cushion therein;

an open pocket within the cavity and having a pocket panel with two side edges that are connected to one of the two fabric side panels and are laterally offset from outer portions of said common side margins of the two fabric side panels, the pocket panel also having two end edges that are connected to the one of the two fabric side panels, wherein a portion of the one of the two fabric side panels is bounded by the two side edges and by the two end edges of the pocket panel, the open pocket defining a slit that extends lengthwise between the two end edges of the pocket panel and is of a shorter distance than a length of the pocket panel between the two end edges, one of the pocket panel and the bounded portion of the one of the two fabric side panels having the slit therein, the open pocket being configured to accommodate as contents therein the neck support cushion; and a releasable fastener arranged to prevent the contents of the open pocket from leaving the open pocket via the slit with the releasable fastener in a fastened condition and to allow the contents of the open pocket to leave the open pocket via the slit with the releasable fastener in a released condition.

2. The pillowcase as in claim 1, in combination with the pillow and the neck support cushion; wherein said pillowcase and said pillow define respective rectangular edges.

3. The pillowcase as in claim 1, wherein the releasable fastener includes pairs of fabric straps that tie together into knots in the fastened condition and untie in the released condition, pairs of the fabric straps having ends sewn to the one of the two fabric side panels on opposite sides of the slit.

4. The pillowcase as in claim 1, wherein one of the two end edges of the pocket panel and the one common margin of the two fabric side panels are connected together.

5. The pillowcase as in claim 1, wherein open end of the pillowcase is formed by overlapping fabric at the remaining end margin of the two fabric side panels and sewing an end of the overlapping fabric to the two fabric side panels to form a seam, the open pocket extending to the seam and connected to the one of the two fabric side panels at the seam.

6. The pillowcase as in claim 1, wherein the releasable fastener is selected from the group consisting of a zipper, buttons, snap fasteners, hook and loop fasteners, and a string passing through alternating fabric loops from sides of the slit and whose ends are knotted.

7. The pillowcase as in claim 1, wherein the slit is in the pocket panel, said pillowcase being configured to be foldable inside out to enable a full lengthwise distance of the slit of the open pocket to become accessible from outside the pillowcase.

* * * * *